US009832825B2

(12) United States Patent
Motomura et al.

(10) Patent No.: US 9,832,825 B2
(45) Date of Patent: Nov. 28, 2017

(54) SIGNAL TRANSMITTING DEVICE, SIGNAL RECEIVING DEVICE, LIGHTING SYSTEM, ILLUMINATING FIXTURE, AND ILLUMINATING SYSTEM

(71) Applicant: Panasonic Intellectual Property Management Co., Ltd., Osaka (JP)

(72) Inventors: Masashi Motomura, Osaka (JP); Hirofumi Konishi, Osaka (JP); Kenichi Fukuda, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 15/373,324

(22) Filed: Dec. 8, 2016

(65) Prior Publication Data

US 2017/0188421 A1 Jun. 29, 2017

(30) Foreign Application Priority Data

Dec. 28, 2015 (JP) ..... 2015-256902

(51) Int. Cl.
*H05B 37/02* (2006.01)
*H05B 33/08* (2006.01)

(52) U.S. Cl.
CPC ..... *H05B 33/0815* (2013.01); *H05B 33/0845* (2013.01); *H05B 37/0272* (2013.01)

(58) Field of Classification Search
CPC . H05B 33/0815; H05B 33/0845; H05B 37/02
USPC ..... 315/291
See application file for complete search history.

(56) References Cited

U.S. PATENT DOCUMENTS

2011/0012521 A1* 1/2011 Byun ..... G09G 3/3406 315/186
2014/0015443 A1* 1/2014 Nakajo ..... H05B 33/0896 315/297
2014/0097764 A1* 4/2014 Ueda ..... H05B 33/0818 315/200 R
2015/0366014 A1* 12/2015 Itoh ..... H05B 33/0815 315/200 R

FOREIGN PATENT DOCUMENTS

JP 2009-159653 7/2009

* cited by examiner

*Primary Examiner* — Don Le
(74) *Attorney, Agent, or Firm* — Renner, Otto, Boisselle & Sklar, LLP

(57) ABSTRACT

The signal transmitting device includes: a transmitter-side input for receiving a first DC voltage; a transmitter-side output for outputting a second DC voltage; and a voltage conversion circuit configured to convert the first DC voltage into the second DC voltage. Further, the signal transmitting device includes a control circuit configured to control the voltage conversion circuit so that the second DC voltage has a voltage value (selected from a first voltage value and a second voltage value) which changes according to transmission data in a predetermined transmission period.

11 Claims, 7 Drawing Sheets

SIGNAL TRANSMITTING DEVICE, SIGNAL RECEIVING DEVICE, LIGHTING SYSTEM, ILLUMINATING FIXTURE, AND ILLUMINATING SYSTEM

CROSS-REFERENCE TO RELATED APPLICATION

The present application is based upon and claims the benefit of priority of Japanese Patent Application No. 2015-256902, filed on Dec. 28, 2015, the entire contents of which are incorporated herein by reference.

TECHNICAL FIELD

The present disclosure relates to signal transmitting devices, signal receiving devices, lighting systems, illuminating fixtures, and illuminating systems.

BACKGROUND ART

For example, JP 2009-159653 A discloses an illuminating system which includes an illuminating fixture electrically and directly connected to a DC line in a residence or an illuminating fixture electrically connected to a DC line through a wiring device such as a ceiling-mounted socket. Such DC lines each include two DC power supply paths, and are electrically connected to an AC/DC converter provided to a residential power distribution panel. Further, such illuminating fixtures each include a light source powered by a DC voltage to light (emit light) such as a light emitting diode (LED) and an organic electroluminescence element. Since the illuminating fixture lights with DC power supplied through the DC power supply paths, it need not include a power supply circuit such as an AC/DC converter for converting an AC voltage into a DC voltage.

In the illuminating system, the DC power supply paths are used as power supply paths for DC power as well as communication paths (transmission paths). For example, a communication signal (transmission signal) for transmitting data by use of a high frequency carrier is superimposed on a DC voltage. A switch device connected to the DC power supply paths transmits instructions for controlling the illuminating fixture (e.g., turning on, turning off, and dimming) by the transmission signal superimposed on the DC voltage. The illuminating fixture receives the transmission signal transmitted from the switch device and turns on, turns off, or dims a light source according to the control instructions included in the transmission signal.

Note that, in a case where the transmission signal generated by modulating a high frequency carrier is superimposed on a DC voltage like a case of the illuminating system, the indoor wiring is likely to act like an antenna to thus emits electromagnetic waves (considered to be noises), and the transmission signal (considered to be noises) is likely to be leaked to an adjacent residence through a power supply cable. For this reason, in the field of such illuminating systems, it is desired to reduce noises which would be caused by transmission and reception of transmission signals (transmission data).

An object of the present disclosure would be to propose a signal transmitting device, a signal receiving device, a lighting system, an illuminating fixture, and an illuminating system which are capable of reducing noises which would be caused by transmission and reception of transmission data.

SUMMARY

The signal transmitting device of one aspect according to the present disclosure includes: a transmitter-side input for receiving a first DC voltage; a transmitter-side output for outputting a second DC voltage; and a voltage conversion circuit configured to convert the first DC voltage into the second DC voltage. The signal transmitting device includes a control circuit configured to control the voltage conversion circuit so that the second DC voltage has a voltage value which changes according to transmission data in a predetermined transmission period.

The signal receiving device of another aspect according to the present disclosure includes: a receiver-side input to be electrically connected to the transmitter-side output of a signal transmitting device of the above aspect so as to receive the second DC voltage; and a receiver circuit configured to obtain transmission data by detecting change in the voltage value of the second DC voltage.

The lighting system of another aspect according to the present disclosure includes: a signal transmitting device including a transmitter-side input for receiving a first DC voltage, a transmitter-side output for outputting a second DC voltage, a voltage conversion circuit configured to convert the first DC voltage into the second DC voltage, and a control circuit configured to control the voltage conversion circuit so that the second DC voltage has a voltage value which changes according to transmission data in a predetermined transmission period; a signal receiving device including a receiver-side input electrically connected to the transmitter-side output of the signal transmitting device so as to receive the second DC voltage, and a receiver circuit configured to obtain the transmission data by detecting change in the voltage value of the second DC voltage; and a lighting device configured to light a light source with the second DC voltage outputted from the transmitter-side output of the signal transmitting device and configured to change a state of the light source according to the data obtained by the receiver circuit of the signal receiving device.

The illuminating fixture of another aspect according to the present disclosure includes: a signal receiving device of the above aspect; a light source; and a lighting device configured to light the light source with the second DC voltage. The lighting device is configured to change a state of the light source according to the transmission data obtained by the receiver circuit of the signal receiving device.

The illuminating system of another aspect according to the present disclosure includes: the lighting system of the above aspect; and the light source to be lit by the lighting device of the lighting system.

The illuminating system of another aspect according to the present disclosure includes a signal transmitting device; and a plurality of the illuminating fixtures. The signal transmitting device includes: a transmitter-side input for receiving a first DC voltage; a transmitter-side output for outputting a second DC voltage; a voltage conversion circuit configured to convert the first DC voltage into the second DC voltage; and a control circuit configured to control the voltage conversion circuit so that the second DC voltage has a voltage value which changes according to transmission data in a predetermined transmission period. Each of the illuminating fixtures includes: a signal receiving device including a receiver-side input electrically connected to the transmitter-side output of the signal transmitting device so as to receive the second DC voltage, and a receiver circuit configured to obtain the transmission data by detecting change in the voltage value of the second DC voltage; a light source; and a lighting device configured to light the light source with the second DC voltage and configured to change a state of the light source according to the data obtained by the receiver circuit of the signal receiving device. The lighting device and the signal receiving device of each of the illuminating fixtures are electrically connected in parallel with the transmitter-side output of the signal transmitting device through a power supply path to be supplied with the second DC voltage.

BRIEF DESCRIPTION OF THE DRAWINGS

The figures depict one or more implementations in accordance with the present teaching, by way of example only, not by way of limitations. In the figures, like reference numerals refer to the same or similar elements.

DETAILED DESCRIPTION

Hereinafter, a signal transmitting device, a signal receiving device, a lighting system, an illuminating fixture, and an illuminating system according of embodiments according to the present disclosure are described in detail with reference to the attached drawings. The embodiments described below relate to a signal transmitting device for transmitting transmission data by changing a voltage value of a DC voltage, and a signal receiving device for receiving transmission data transmitted from the signal transmitting device. Further, the embodiments described below relate to a lighting system including a signal transmitting device, a signal receiving device, and a lighting device for lighting a light source, and an illuminating fixture including a signal receiving device, a lighting device, and a light source. Additionally, the embodiments described below relate to an illuminating system including a signal transmitting device, a signal receiving device, a lighting device, and a light source, and an illuminating system including a plurality of illuminating fixtures electrically connected in parallel with a signal transmitting device. Note that, the embodiments described below are merely some of possible embodiments of the present disclosure, and may be modified according to design or the like.

Figure 1:
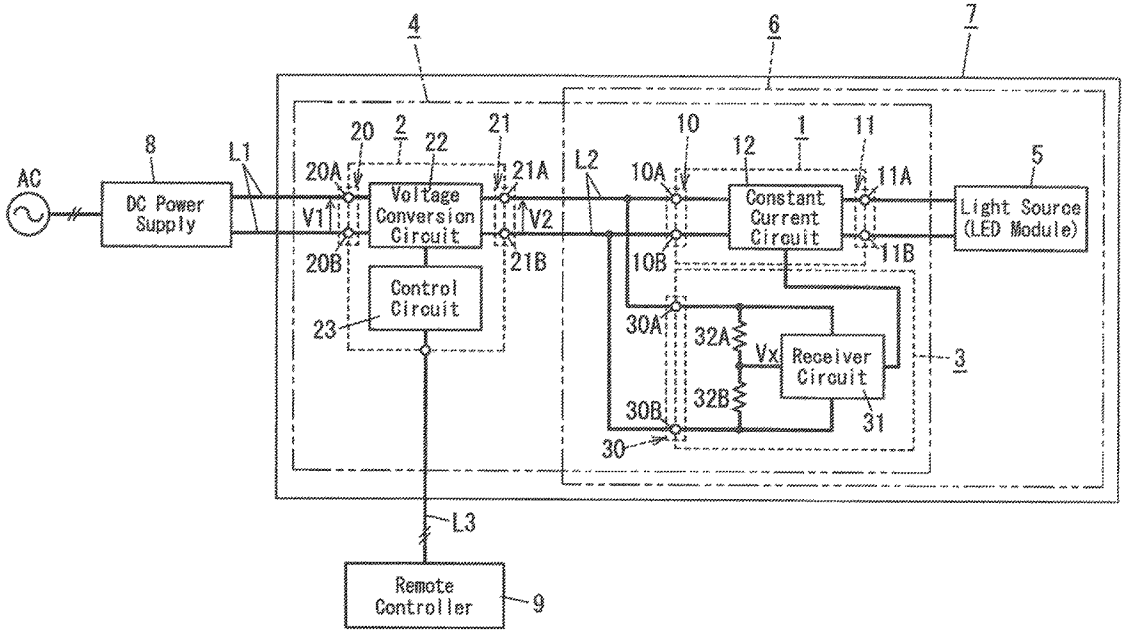
FIG. 1 is a block diagram of a signal transmitting device and an illuminating fixture of one embodiment according to the present disclosure.

As shown in FIG. 1, a lighting system 4 includes a lighting device 1, a signal transmitting device 2, and a signal receiving device 3. Note that, preferably, the lighting system 4 may be installed in a living room of a residence, but may be installed in an office of a business place or in a store of premises.

The signal transmitting device 2 includes a transmitter-side input 20, a transmitter-side output 21, a voltage conversion circuit 22, and a control circuit 23. The transmitter-side input 20 includes a pair of transmitter-side input terminals 20A and 20B. Preferably, these transmitter-side input terminals 20A and 20B may include screw terminals or quick connection terminals, for example. The transmitter-side input 20 is electrically connected to a first power supply path L1 and thus can receive a DC voltage (a first DC voltage V1) through the first power supply path L1. The first power supply path L1 includes two electric wires. A first one of the two electric wires, which serves as a high potential side (positive) electric wire, has a first end electrically connected to the transmitter-side input terminal 20A. A second one of the two electric wires, which serves as a low potential side (negative) electric wire, has a first end electrically connected to the transmitter-side input terminal 20B. Note that, the two electric wires of the first power supply path L1 have second ends electrically connected to a DC power supply 8.

The DC power supply 8 converts an AC voltage supplied from a power system AC into a DC voltage and outputs the resultant DC voltage to the first power supply path L1. The AC voltage may have an effective value of 100 [V], and a power supply frequency of 50 [Hz] or 60 [Hz], for example. The DC voltage may have a rated value in a range of 30 [V] to 40 [V]. The DC power supply 8 may include an input filter, a full-wave rectifier, and a DC/DC converter such as a power factor improvement circuit and a step-down chopper circuit, for example. Preferably, the DC power supply 8 may be placed inside a power distribution panel for indoor wiring such as a residential power distribution panel. Alternatively, the DC power supply 8 may increase or decrease a DC voltage supplied from a photovoltaic power system and thus output a resultant voltage to the first power supply path L1, for example. Note that, when the DC power supply 8 is not used, the signal transmitting device 2 may itself include an AC/DC converter for converting an AC voltage supplied from the power system AC into a DC voltage.

Figure 2A:
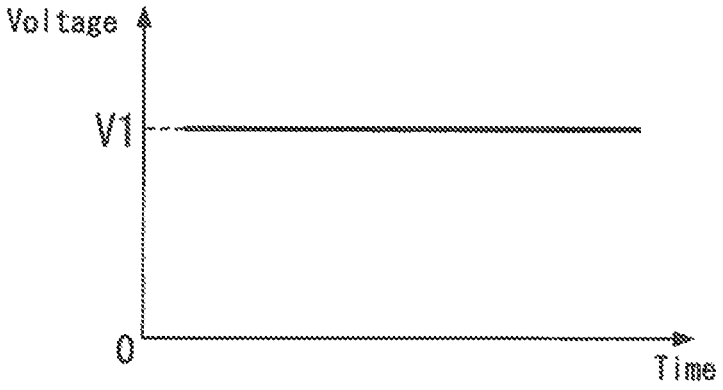
FIG. 2A is a waveform chart of a first DC voltage inputted into the above signal transmitting device.
Figure 2B:
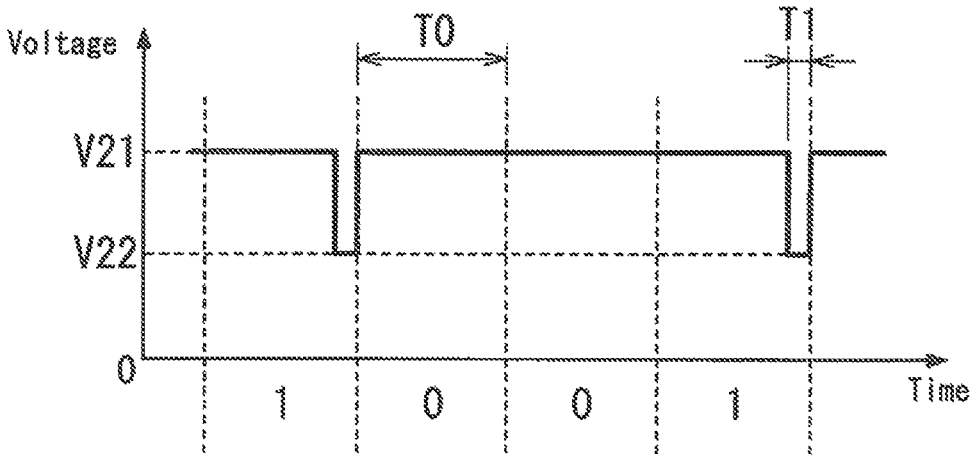
FIG. 2B is a waveform chart of a transmission signal transmitted from the above signal transmitting device.

Further, the signal transmitting device 2 includes the voltage conversion circuit 22 and the control circuit 23. The voltage conversion circuit 22 is configured to convert the first DC voltage V1 received by the transmitter-side input 20 into a second DC voltage V2 (as shown in FIG. 2A and FIG. 2B). The second DC voltage V2 is outputted from the transmitter-side output 21 to a second power supply path L2. The transmitter-side output 21 includes a pair of transmitter-side output terminals 21A and 21B. Preferably, these transmitter-side output terminals 21A and 21B may include screw terminals or quick connection terminals, for example. The transmitter-side output 21 is electrically connected to the second power supply path L2 and thus can output a DC voltage (the second DC voltage V2) to the second power supply path L2. The second power supply path L2 includes two electric wires. A first one of the two electric wires, which serves as a high potential side (positive) electric wire, is electrically connected to the transmitter-side output terminal 21A. A second one of the two electric wires, which serves as a low potential side (negative) electric wire, is electrically connected to the transmitter-side output terminal 21B.

The voltage conversion circuit 22 may preferably include a variable three-terminal regulator with a variable output voltage, for example. In detail, the voltage conversion circuit 22 is controlled by the control circuit 23 so that a voltage value of the second DC voltage V2 can be switched between a first voltage value (rated value) V21 and a second voltage value V22 smaller than the first voltage value V21. Note that, the first voltage value V21 may be equal to or different from a voltage value (rated value) of the first DC voltage V1. Additionally, the second voltage value V22 may preferably be equal to or larger than a voltage value necessary for the lighting device 1 to turn on a light source 5. Alternatively, the voltage conversion circuit 22 may include a switching regulator instead of a variable three-terminal regulator. The variable three-terminal regulator can decrease an input voltage (decrease a voltage value) only whereas the switching regulator can decrease an input voltage and alternatively can increase or increase and decrease an input voltage. For this reason, when the voltage value of the second DC voltage V2 is set to be higher than the voltage value of the first DC voltage V1, it is preferable that the voltage conversion circuit 22 may include a step-up switching regulator.

The control circuit 23 may include a microcontroller or a control IC. The control circuit 23 is configured to receive a control signal transmitted from a remote controller 9 through a signal line L3. Additionally, the control circuit 23 is configured to convert a dimming level indicated by the control signal received into transmission data, and control the voltage conversion circuit 22 according to the transmission data. Note that, the dimming level is defined as a value ([%]) representing in percentage terms a ratio of a current supplied to the light source 5 to a rated value. The transmission data may be constituted by a sequence of 8 bits representing up to 256 values individually associated with 256 dimming levels, for example. For example, the dimming level of 100[%] is associated with (converted into) a sequence of bits of "00000000". The dimming level of 0[%] (turning off) is associated with (converted into) a sequence of bits of "11111111". The dimming level of 50[%] is associated with (converted into) a sequence of bits of "10000000". Note that, the number of dimming levels may not necessarily be 256, but may be 128, 512, or one or more to twenty or less levels, for example. In the present embodiment, the dimming level of 0[%] corresponds to control information for turning off the light source 5. The dimming levels other than the dimming level of 0[%] correspond to the control information for turning on the light source 5 which is in an off-state. Additionally, the dimming levels of 100[%] to 0[%] correspond to the control information for adjusting light output of the light source 5 (dimming the light source 5). Note that, the control information for turning off the light source 5 may be a command indicative of turning off the light source 5. Further, the control information for turning on the light source 5 may be a command indicative of turning on the light source 5.

For example, when a given one of bits of the transmission data has indicates "1", the control circuit 23 controls the voltage conversion circuit 22 so as to change the voltage value of the second DC voltage V2 to the second voltage value V22 smaller than the first voltage value V21 (see FIG. 2B). In contrast, when a given one of bits of the transmission data has indicates "0", the control circuit 23 controls the voltage conversion circuit 22 so as to change the voltage value of the second DC voltage V2 to the first voltage value V21 (see FIG. 2B). In detail, the control circuit 23 is configured to define a transmission period for transmitting the transmission data of 8 bits as eight time slots having a constant time width T0 (see FIG. 2B). When a given one of bits of the transmission data has "1", the control circuit 23 controls the voltage conversion circuit 22 so that the voltage value of the second DC voltage V2 is kept changed to the second voltage value V22 within a time period having a time width T1 shorter than the time width T0 of each time slot (see FIG. 2B). Note that, the control circuit 23 controls the voltage conversion circuit 22 so that a rising edge of the second DC voltage V2 (timing of an increase from the second voltage value V22 to the first voltage value V21) coincides with an end timing of a corresponding time slot. However, it is sufficient that the control circuit 23 may change the voltage value of the second DC voltage V2 to the second voltage value V22 within a given period in a corresponding time slot. For example, the control circuit 23 may control the voltage conversion circuit 22 so that a falling edge of the second DC voltage V2 (timing of a decrease from the first voltage value V21 to the second voltage value V22) coincides with a start timing of a corresponding time slot.

In this regard, the control circuit 23 controls the voltage conversion circuit 22 to send a start bit indicating start of the transmission period prior to a first bit of the transmission data and send an end bit indicating end of the transmission period subsequent to a last bit of the transmission data. For example, the start bit may be a sequence of bits of "111", and the stop bit may be a sequence of bits of "000". Note that, the transmission data has a fixed length of 8 bits. For this reason, even when the stop bit is not transmitted from the signal transmitting device 2, the signal receiving device 3 can still determine whether the transmission period has ended. Note that, in the present embodiment, a signal transmitted by switching a voltage between wires of the power supply path L2 (the second DC voltage V2) between the first voltage value V21 and the second voltage value V22 within the transmission period is named as a transmission signal. The transmission signal may include the start bit, the transmission data, and the stop bit, but may not include the stop bit if necessary. Further, the control circuit 23 is configured to, in a period different from the transmission period (a period other than the transmission period), control the voltage conversion circuit 22 so as to keep the voltage value of the second DC voltage V2 equal to the first voltage value V21.

Figure 3:
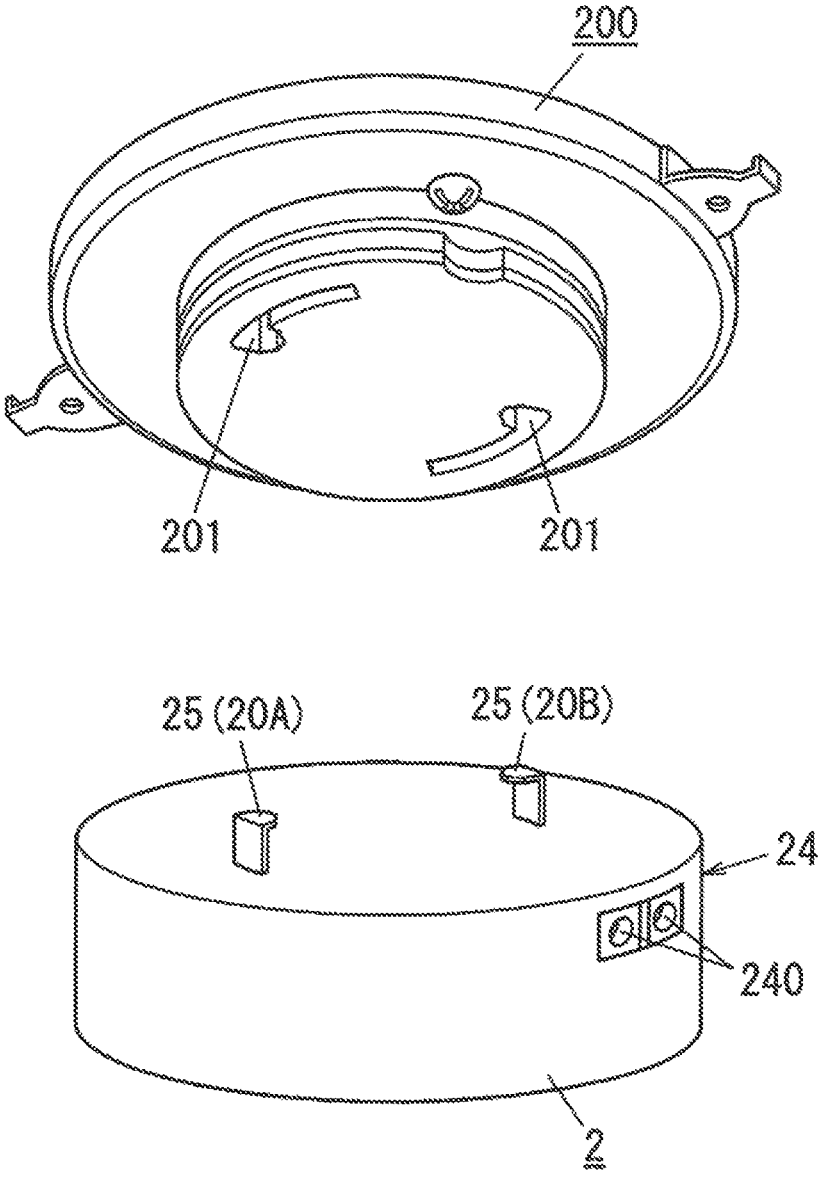
FIG. 3 is a perspective view of the above signal transmitting device and a ceiling-mounted socket.

Note that, the first power supply path L1 may be electrically connected to a wiring device for power supply. For example, the wiring device for power supply may be a ceiling-mounted socket 200 installed in a ceiling (a finishing material of ceilings) of a residence (see FIG. 3). The ceiling-mounted socket 200 is electrically connected to the first power supply path L1 which may be preliminarily installed above the ceiling and thus is supplied with DC power from the DC power supply 8 through the first power supply path L1. As shown in FIG. 3, the signal transmitting device 2 includes a housing 24 in a hollow circular cylindrical shape. Preferably, the housing 24 may be made of material with electrically insulating properties such as synthetic resin, for example. There is a pair of hooking-blades 25 protruding from an upper face of the housing 24. By engaging the pair of hooking-blades 25 with hooking-blade receivers 201 of the ceiling-mounted socket 200, the signal transmitting device 2 is mechanically and electrically connected to the ceiling-mounted socket 200. In summary, the pair of hooking-blades 25 serves as the input terminals 20A and 20B of the transmitter-side input 20. The housing 24 accommodates a pair of quick connection terminals, and this pair of quick connection terminals electrically connects the output terminals 21A and 21B of the transmitter-side output 21 of the signal transmitting device 2 to the second power supply path L2. Note that, the housing 24 includes at its outer periphery a pair of electric wire insertion holes 240 for allowing connection of electric wires to the pair of quick connection terminals.

Figure 4:
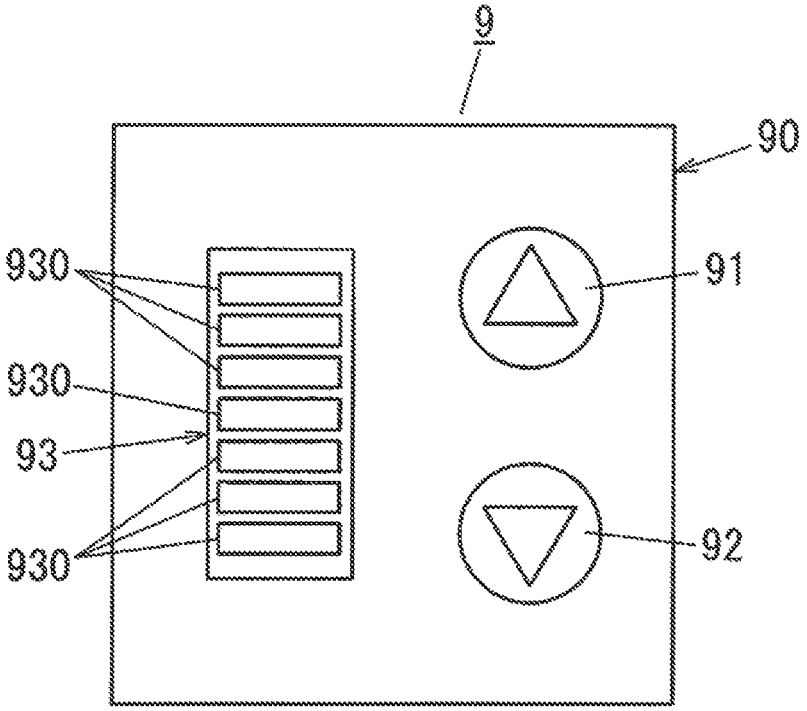
FIG. 4 is a front view of a remote commander used together with a lighting system of one embodiment according to the present disclosure.

As shown in FIG. 4, the remote controller 9 includes a body 90 of a synthetic resin molded product. The body 90 is attached to a wall so that part (mainly, a rear part) of the body 90 is inserted into a recess created in a wall material, for example. Additionally, the remote controller 9 includes a first manual operation button 91, a second manual operation button 92, and a display 93. The first manual operation button 91 is exposed on a front face of the body 90. The second manual operation button 92 is exposed on the front face of the body 90 so as to be beneath the first manual operation button 91. The display 93 includes seven display elements (e.g., light emitting diodes) 930 arranged in a line along a vertical direction. The display 93 is configured to light a predetermined number of seven display elements 930 according to the dimming level which is set by a user pushing the first manual operation button 91 and the second manual operation button 92.

When the first manual operation button 91 is pushed, the remote controller 9 increases the dimming level from a value immediately before the first manual operation button 91 is pushed, and sends through the signal line L3 a dimming signal indicative of the dimming level increased. In contrast, when the second manual operation button 92 is pushed, the remote controller 9 decreases the dimming level from a value immediately before the first manual operation button 91 is pushed, and sends through the signal line L3 a dimming signal indicative of the dimming level decreased. Additionally, the remote controller 9 lights the uppermost display element 930 when the dimming level is 100[%], and lights a lower display element 930 as the dimming level becomes lower. Hence, a person operating the remote controller 9 can roughly perceive the dimming level by checking which one of the display elements 930 of the display 93 lights. Note that, a device used for controlling the dimming level of an illuminating fixture like the aforementioned remote controller 9 is also called a dimmer in some cases.

Referring again to FIG. 1, the lighting device 1 includes a lighting-side input 10, a lighting-side output 11, and a constant current circuit 12. The lighting-side input 10 includes a pair of lighting-side input terminals 10A and 10B. Preferably, these lighting-side input terminals 10A and 10B may include screw terminals or quick connection terminals, for example. The lighting-side input 10 is electrically connected to the second power supply path L2 and thus can receive the second DC voltage V2 through the second power supply path L2. The lighting-side input terminal 10A is electrically connected to a first end of the first one, which serves as a high potential side (positive) electric wire, of the two electric wires constituting the second power supply path L2. The lighting-side input terminal 10B is electrically connected to a first end of the second one, which serves as a low potential side (negative) electric wire, of the two electric wires constituting the second power supply path L2. Note that, the two electric wires of the second power supply path L2 have second ends electrically connected to the transmitter-side output terminals 21A and 21B of the transmitter-side output 21 of the signal transmitting device 2.

The lighting-side output 11 includes a pair of lighting-side output terminals 11A and 11B. Preferably, these lighting-side output terminals 11A and 11B may include screw terminals or quick connection terminals, for example. The lighting-side output 11 is electrically connected to the light source 5. For example, the light source 5 includes one or more LED modules. The LED module may include a mounting substrate, one or more LED chips mounted on one surface of the mounting substrate, and an encapsulating member for encapsulating the one or more LED chips, for example. The encapsulating member may be made of light transmissive encapsulating material such as silicone resin. Note that, the LED chip may be a blue LED chip for emitting blue light, and the encapsulating material contains phosphor for converting blue light into yellow light. In summary, the LED module is designed to emit white light obtained by mixing the blue light with the yellow light. Note that, the light source 5 is not limited to one or more LED modules, but may be a straight LED lamp or an organic electroluminescence element.

The lighting-side output terminal 11A serving as a high potential side terminal is electrically connected to a positive electrode of the light source 5 (an anode electrode of an LED module). The lighting-side output terminal 11B serving as a low potential side terminal is electrically connected to a negative electrode of the light source 5 (a cathode electrode of an LED module). The constant current circuit 12 includes a DC/DC converter such as a switching regulator and a series regulator. For example, when a rated voltage value (the first voltage value V21) of the second DC voltage V2 inputted from the signal transmitting device 2 into the lighting-side input 10 is higher than a rated voltage of the light source 5, the constant current circuit 12 may preferably include a step-down chopper circuit. Alternatively, when the first voltage value V21 is lower than the rated voltage of the light source 5, the constant current circuit 12 may preferably include a step-up chopper circuit. In the present embodiment, the constant current circuit 12 includes a step-down chopper circuit in order to increase the rated voltage value of the second DC voltage V2 so as to be higher than the rated voltage of the light source 5. The constant current circuit 12 operates to make an output current supplied from the lighting-side output 11 to the light source 5 equal to a desired value. Therefore, when the desired value is changed, the constant current circuit 12 increases or decreases the output current so as to turn off, light at rated power, or light at given power the light source 5.

The signal receiving device 3 includes a receiver-side input 30, a receiver circuit 31, and a voltage dividing circuit (see FIG. 1). The receiver-side input 30 includes a pair of receiver-side input terminals 30A and 30B. Preferably, these receiver-side input terminals 30A and 30B may include screw terminals or quick connection terminals, for example. Note that, the receiver-side input terminals 30A and 30B of the receiver-side input 30 may be electrically connected, in the lighting device 1, to the lighting-side input terminals 10A and 10B of the lighting-side input 10, respectively. Additionally, a printed circuit serving as the constant current circuit 12 of the lighting device 1 and a printed circuit serving as the receiver circuit 31 and the voltage dividing circuit of the signal receiving device 3 may be formed on the same printed circuit board. The receiver-side input 30 is electrically connected to the second power supply path L2 and thus can receive the second DC voltage V2 through the second power supply path L2. The first one of the two electric wires constituting the second power supply path L2, which serves as a high potential side (positive) electric wire, is electrically connected to the receiver-side input terminal 30A. The second one of the two electric wires constituting the second power supply path L2, which serves as a low potential side (negative) electric wire, is electrically connected to the receiver-side input terminal 30B.

The voltage dividing circuit includes a series circuit of two resistors 32A and 32B. The voltage dividing circuit is electrically connected between the pair of receiver-side input terminals 30A and 30B, and thus can output a voltage (a detection voltage Vx) divided from a voltage between electric wires of the second power supply path L2 (the second DC voltage V2) to the receiver circuit 31. The receiver circuit 31 may include a microcontroller or a control IC. The receiver circuit 31 samples the detection voltage Vx inputted from the voltage dividing circuit at a constant sampling period and stores it in a buffer memory. Note that, the sampling period is set to be shorter than the time width T1 in which the signal transmitting device 2 transmits one bit of the transmission data.

The receiver circuit 31 compares the sampled value (a voltage value of the detection voltage Vx) stored in the buffer memory with a threshold value to thereby receive the transmission signal (the start bit, the transmission data, and the stop bit). In detail, then the sampled value falls below the threshold value, the receiver circuit 31 determines reception of a bit of "1" and then stores the bit ("1") in the buffer memory. When receiving the start bit, the receiver circuit 31 receives the transmission bits transmitted subsequent to the start bit, and stores them in the buffer memory. When receiving the stop bit, the receiver circuit 31 finishes storing of data in the buffer memory.

The receiver circuit 31 obtains the dimming level from the transmission data stored in the buffer memory. Additionally, the receiver circuit 31 converts the obtained dimming level into a PWM signal, and then outputs it to the constant current circuit 12 of the lighting device 1. The receiver circuit 31 changes a duty cycle of a rectangular wave with a constant period according to the dimming level, thereby converting the dimming level into the PWM signal. For example, the receiver circuit 31 sets the duty cycle to 100[%] when the dimming level is 100[%], and sets the duty cycle to 0[%] when the dimming level is 0[%], and sets the duty cycle to 50[%] when the dimming level is 50[%]. Alternatively, the receiver circuit 31 may convert the dimming level into a voltage signal with a voltage value representing the dimming level.

In contrast, the constant current circuit 12 changes the desired value of the output current according to the PWM signal received from the receiver circuit 31. For example, when the duty cycle of the PWM signal is 100[%], the constant current circuit 12 sets the desired value of the output current to a rated value (a current value of a rated current of the light source 5). Further, when the duty cycle of the PWM signal is 50[%], the constant current circuit 12 sets the desired value of the output current to half of the rated value. Note that, when the duty cycle of the PWM signal is 0[%], the constant current circuit 12 ends outputting of the output current to turn off the light source 5.

Figure 5:
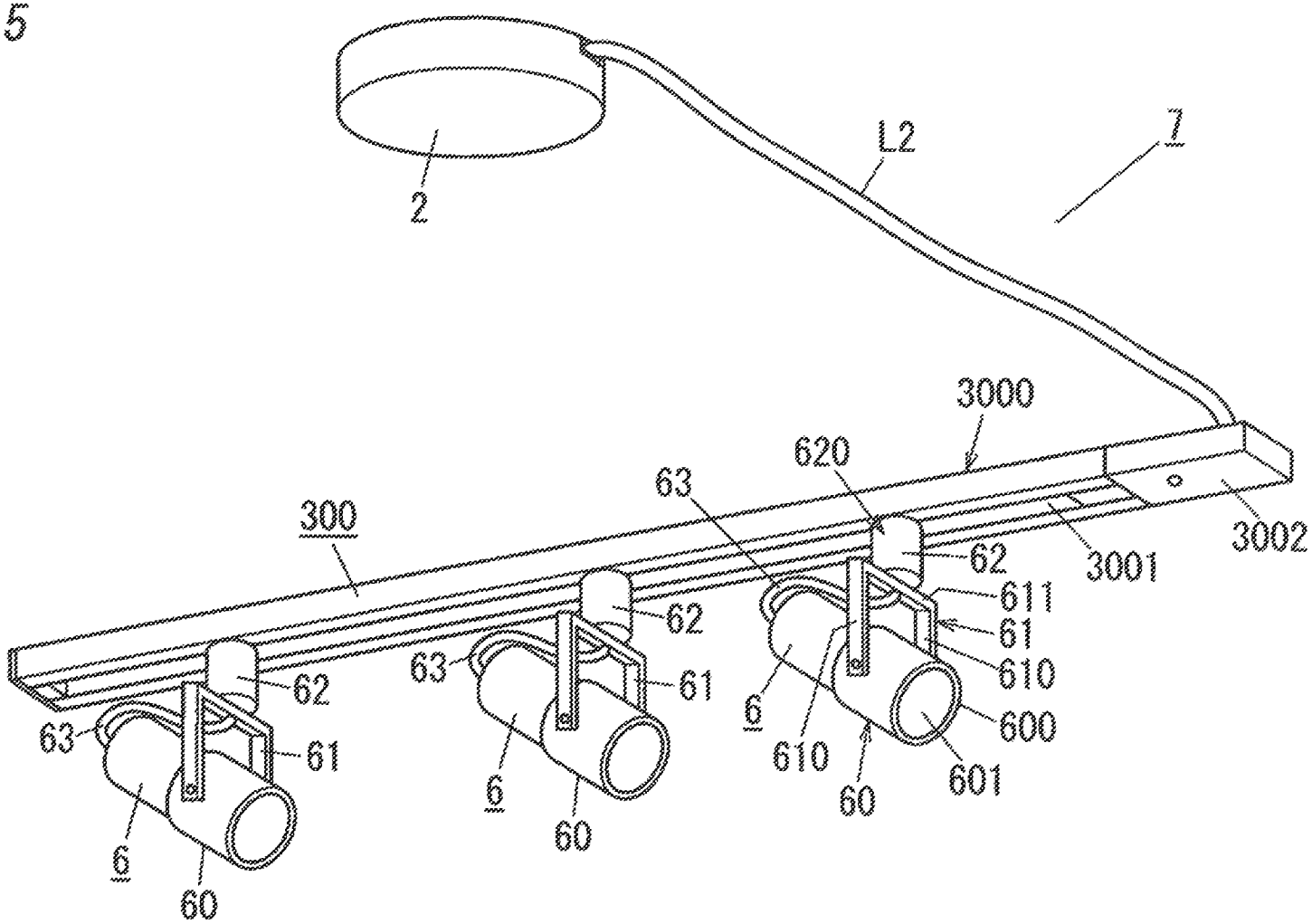
FIG. 5 is a system configuration diagram of an illuminating system of one embodiment according to the present disclosure.

Note that, the lighting device 1, the signal receiving device 3, and the light source 5 may be included in components of an illuminating fixture 6. For example, as shown in FIG. 5, the illuminating fixture 6 is a spotlight used in combination with a lighting duct for illuminating fixtures (hereinafter, referred to as "duct") 300. The duct 300 is attached to a ceiling (a lower face of a finishing material of ceilings). The duct 300 includes a duct body 3000 of synthetic resin, and two conductors (not shown) accommodated inside the duct body 3000. The duct body 3000 has a hollow elongated cuboidal shape. The duct body 3000 has at its lower face an insertion opening 3001 which has a straight shape extending along a lengthwise direction of the duct body 3000. The two conductors are fixed inside the duct body 3000 so as to be on opposite sides of the insertion opening 3001 when viewed from the lower side. Further, there is a feed-in unit 3002 electrically and mechanically connected to one end in the lengthwise direction of the duct body 3000. The feed-in unit 3002 electrically connects the two electric wires of the second power supply path L2 to the two conductors inside the duct body 3000 individually. Therefore, the duct 300 is supplied with the second DC voltage V2 from the signal transmitting device 2.

The illuminating fixture 6 includes a body 60, an arm 61, and a plug 62. The body 60 is made of metal or synthetic resin. The body 60 has a shape that two hollow circular cylinders with different diameters are connected in their common axial direction. The body 60 accommodates inside the light source 5, the lighting device 1, and the signal receiving device 3. Note that, a printed circuit including the constant current circuit 12 of the lighting device 1 and a printed circuit including the receiver circuit 31 and the voltage dividing circuit of the signal receiving device 3 may be included in the same printed circuit board. The body 60 has one end facing the light source 5 and provided with a window hole 600. The window hole 600 is fitted with a panel 601 made of light transmissive material such as glass and acrylic resin. Light produced by the light source 5 is radiated to an illumination space through the panel 601. The plug 62 includes a plug body 620 with a hollow cylindrical shape, and a pair of electrode plates (not shown) protruding from an upper face of the plug body 620. The pair of electrode plates are inserted into the duct body 3000 via the insertion opening 3001 and then in contact with the two conductors fixed inside the duct body 3000 individually. Note that, the pair of electrode plates of the plug 62 are electrically connected to the lighting-side input terminals 10A and 10B of the lighting device 1 accommodated in the body 60 through an electric cable 63. The arm 61 includes a pair of supporting pieces 610 for supporting the body 60 and an interconnecting piece 611 for interconnecting the pair of supporting pieces 610. The arm 61 is attached at a center of the interconnecting piece 611 to the lower face of the plug body 620 in a rotatable manner within a horizontal plane. Further, the pair of supporting pieces 610 of the arm 61 is attached to opposite side faces of the body 60 in a rotatable manner within a vertical plane.

The illuminating fixture 6 is electrically and mechanically connected to the duct 300 through the plug 62. Hence, the illuminating fixture 6 lights with DC power supplied through the duct 300. Note that, an illuminating system 7 includes the signal transmitting device 2 and the illuminating fixture 6 (the light source 5, the lighting device 1, and the signal receiving device 3) (see FIG. 1). As shown in FIG. 5, the illuminating system 7 may include the signal transmitting device 2 and a plurality of the illuminating fixtures 6.

Hereinafter, operations of the lighting system 4 and the illuminating system 7 are described.

For example, a person is assumed to change the dimming level from 100[%] to 50[%] by pushing the second manual operation button 92 of the remote controller 9. The remote controller 9 sends a dimming signal indicative of the dimming level of 50[%] through the signal line L3. When receiving the dimming signal from the remote controller 9, the control circuit 23 of the signal transmitting device 2 converts the dimming level (50[%]) indicated by the dimming signal into the transmission data (a sequence of 8 bits of "10000000"). Further, the control circuit 23 controls the voltage conversion circuit 22 so as to send the start bit first, then send the transmission data, and finally send the stop bit.

The transmission signal which is sent from the signal transmitting device 2 through the second power supply path L2 is received by the signal receiving devices 3 of all the illuminating fixtures 6 through the second power supply path L2 (including the conductors of the duct 300). The receiver circuit 31 of the signal receiving device 3 obtains the dimming level (50[%]) from the transmission data included in the transmission signal received, and further converts the dimming level obtained, into the PWM signal. In summary, the receiver circuit 31 generates the PWM signal with the duty cycle of 50[%], and outputs the PWM signal generated, to the constant current circuit 12 of the lighting device 1.

The constant current circuit 12 sets the desired value of the output current to half of the rated value according to the duty cycle (50[%]) of the PWM signal. Therefore, the current value of the output current outputted from the lighting-side output 11 of the lighting device 1 to the light source 5 becomes equal to half of the rated value. Accordingly, an amount of light (light flux) emitted from the light source 5 also becomes almost half of an amount of light produced by rated lighting. As a result, amounts of light of all the illuminating fixtures 6 connected to the duct 300 are each adjusted to half of the amount of light produced by rated lighting.

In a case where the transmission signal generated by modulating a high frequency carrier is superimposed on a DC voltage like a case of the illuminating system, the indoor wiring is likely to act like an antenna to thus emits electromagnetic waves (considered to be noises), and the transmission signal (considered to be noises) is likely to be leaked to an adjacent residence through a power supply cable. In contrast, the signal transmitting device 2, the lighting system 4 and the illuminating system 7 vary the voltage value of the DC voltage (the second DC voltage V2) supplied through the second power supply path L2 to thereby send the transmission data (the dimming level). Therefore, the signal transmitting device 2, the lighting system 4 and the illuminating system 7 can offer a decrease in noises caused by transmission and reception of the transmission data compared with a case of superimposing the transmission signal generated by modulating the high frequency carrier on the DC voltage. Additionally, both the signal transmitting device 2 and the signal receiving device 3 need not include an oscillator for generating high frequency carriers, and thus circuit configuration thereof can be simplified.

Note that, the signal receiving devices 3 may have unique addresses. When the signal receiving device 3 have unique addresses, the control circuit 23 of the signal transmitting device 2 may send a desired address bit indicative of an address following the start bit, and thereafter send the transmission data. When the address indicated by the address bit of the received transmission signal is identical to the unique address of the signal receiving device 3, the receiver circuit 31 of the signal receiving device 3 converts the dimming level obtained from the transmission data into the PWM signal and outputs the resultant PWM signal to the lighting device 1. In contrast, when the address indicated by the address bit is not identical to the unique address of the signal receiving device 3, the receiver circuit 31 does not obtain the dimming level from the transmission data and discards the transmission data. Allocating unique addresses to the signal receiving devices 3 in such a manner allows individual turning on and off and dimming a plurality of illuminating fixtures 6 connected to the duct 300.

Note that, the light source 5 may include multiple kinds of LED modules with different light emission colors. For example, the light source 5 may include a first LED module for emitting white light and a second LED module for emitting light of a light (lamp) color. Additionally, the lighting device 1 may preferably include a first constant current circuit for lighting the first LED module and a second constant current circuit for lighting the second LED module. The transmission data which indicates a first dimming level of the first LED module and a second dimming level of the second LED module is sent from the signal transmitting device 2 to the signal receiving device 3. The receiver circuit 31 of the signal receiving device 3 converts the first dimming level received from the signal transmitting device 2 into the PWM signal and outputs the resultant PWM signal to the first constant current circuit. Similarly, the receiver circuit 31 of the signal receiving device 3 converts the second dimming level received from the signal transmitting device 2 into the PWM signal and outputs the resultant PWM signal to the second constant current circuit. Accordingly, the first constant current circuit provides a current having a desired value corresponding to the PWM signal received from the receiver circuit 31, to the first LED module. The second constant current circuit provides a current having a desired value corresponding to the PWM signal received from the receiver circuit 31, to the second LED module. Therefore, the light source 5 emits light which is a mixture (or has a mixed color) of white light produced by the first LED module and light (lamp) color light produced by the second LED module. In summary, the illuminating fixture 6, the lighting system 4 and the illuminating system 7 can offer adjustment of a color of light of the light source 5 according to a ratio of the first dimming level to the second dimming level.

Note that, the transmission data is not limited to the dimming level. For example, when an illuminating fixture includes a speaker therein, the transmission data may be a sound (music) file. In this case, the signal transmitting device 2 may send the sound (music) file as the transmission data, and the speaker is operated based on the transmission data received by the signal receiving device 3. Thereby, the illuminating fixture can output a sound (music) by the speaker.

Note that, the signal transmitting device 2 does not necessarily include a structure electrically and mechanically connectable to the ceiling-mounted socket 200. For example, the signal transmitting device 2 may be placed above the ceiling while its components such as the voltage conversion circuit 22 and the control circuit 23 are accommodated in a case made of metal or synthetic resin. The signal transmitting device 2 may be configured so that the housing 24 incorporates the DC power supply 8. The second power supply path L2 electrically interconnecting the signal transmitting device 2 and the lighting device 1 does not necessarily include the duct 300. For example, the second power supply path L2 may be constituted by an electric cable (e.g., a vinyl insulated vinyl sheathed cable) installed above the ceiling. The illuminating fixture 6 may not be limited to a spotlight, but may be a downlight or a flat illuminating fixture which is attached to a wall face for indirect lighting. The lighting device 1 and the signal receiving device 3 may not be incorporated in the body of the illuminating fixture. For example, a case for accommodating the lighting device 1 and the signal receiving device 3 may be separate from the body of the illuminating fixture, and the lighting-side output 11 of the lighting device 1 and the light source 5 may be electrically interconnected by an electric cable. The remote controller 9 may be configured to send the dimming signal by use of a communication medium such as infrared and a radio wave, instead of the signal line L3.

Figure 6:
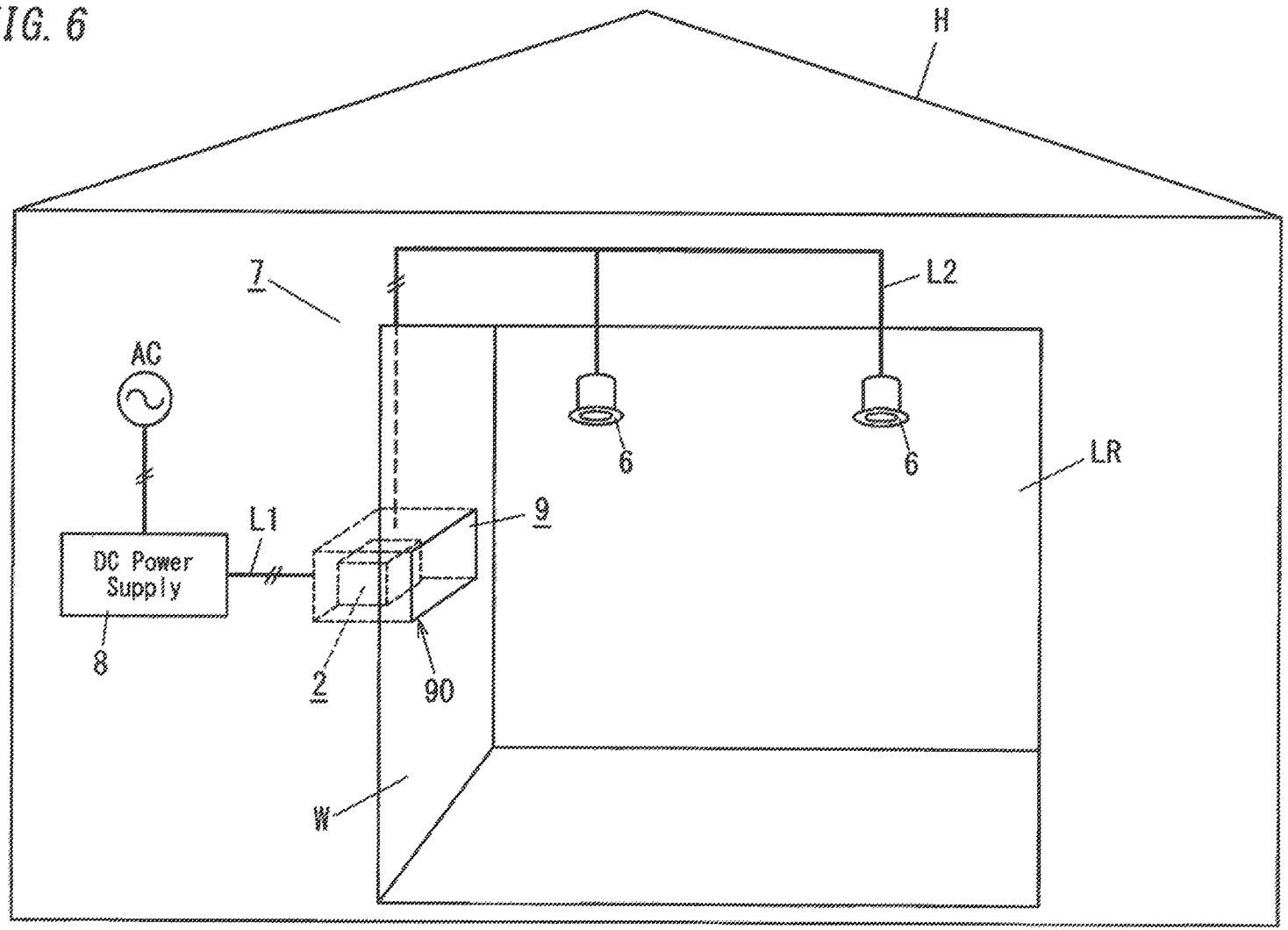
FIG. 6 is a system configuration diagram of a modification of the above illuminating system.
Figure 7:
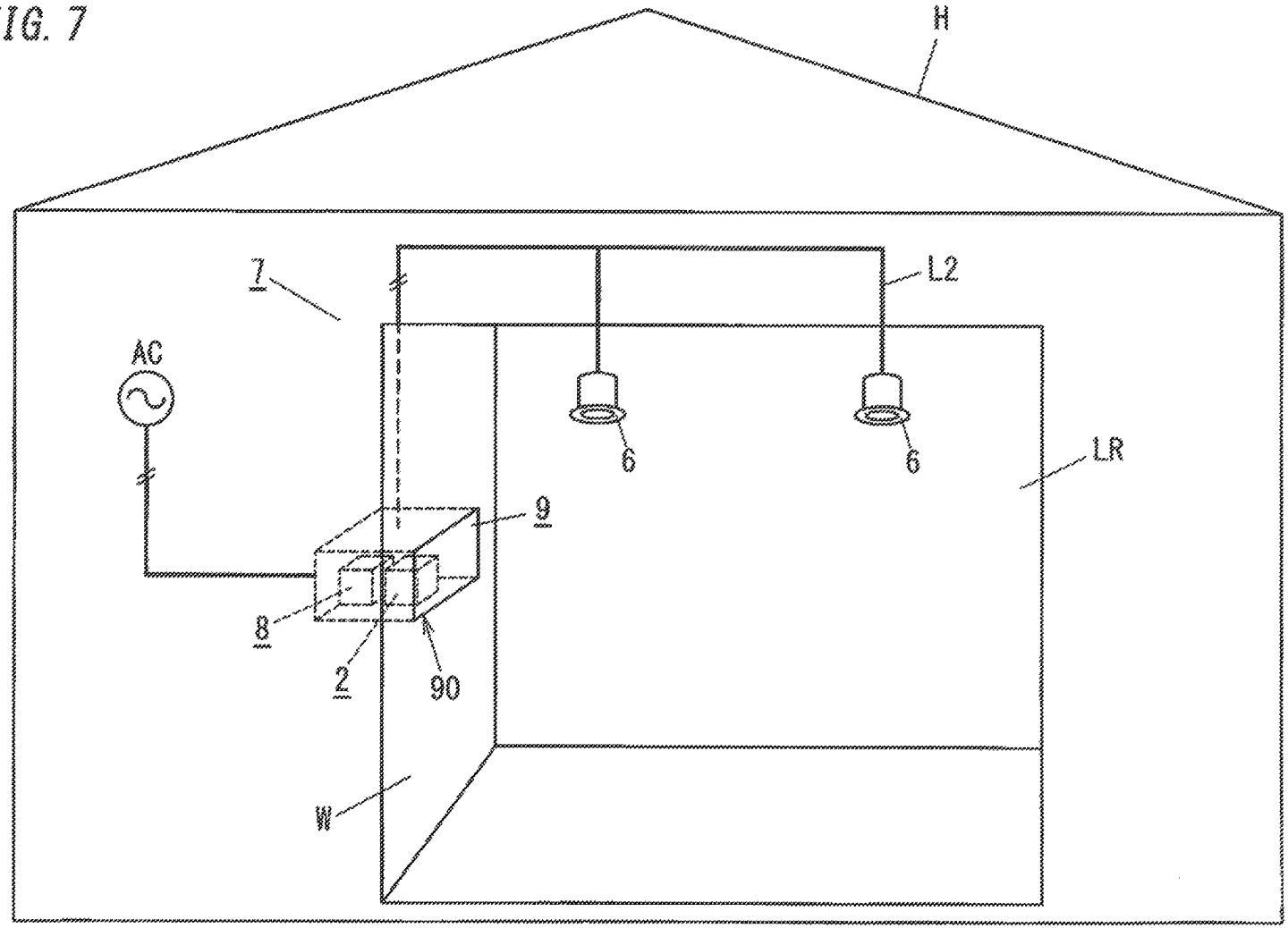
FIG. 7 is a system configuration diagram of another modification of the above illuminating system.

Further, in the illuminating system 7, the signal transmitting device 2 may be accommodated in the body 90 of the remote controller 9, as shown in FIG. 6. Moreover, in the illuminating system 7, the signal transmitting device 2 and the DC power supply 8 may be accommodated in the body 90 of the remote controller 9, as shown in FIG. 7. The body 90 of the remote controller 9 is attached to a wall W of a living room LR of a residence H so that part (mainly, a rear part) of the body 90 is inserted into a recess created in the wall W (see FIG. 6 and FIG. 7). Note that, the remote controller 9 may include a touch panel instead of the first manual operation button 91 and the second manual operation button 92. The remote controller 9 may be configured to receive a wireless signal carried by infrared or a radio wave. This wireless signal may be sent from a wireless transmitter (not shown). The wireless transmitter may be configured to send, as the wireless signal, the control signal for indicating the dimming level.

As described above, the signal transmitting device (2) of the first aspect includes: a transmitter-side input (20) for receiving a first DC voltage (V1); a transmitter-side output (21) for outputting a second DC voltage (V2); and a voltage conversion circuit (22) configured to convert the first DC voltage (V1) into the second DC voltage (V2). Additionally, the signal transmitting device (2) of the first aspect includes a control circuit (23) configured to control the voltage conversion circuit (22) so that the second DC voltage (V2) has a voltage value (the first voltage value V21 and the second voltage value V22) which changes according to transmission data in a predetermined transmission period.

The signal transmitting device (2) of the first aspect varies the voltage value of the second DC voltage (V2) to thereby send the transmission data. Therefore, the signal transmitting device (2) can offer a decrease in noises caused by transmission of the transmission data. Additionally, the signal transmitting device (2) of the first aspect need not include oscillators for generating high frequency carriers, and thus circuit configuration thereof can be simplified.

As apparent from the above, the signal receiving device (3) of the second aspect includes: a receiver-side input (30) to be electrically connected to the transmitter-side output (21) of the signal transmitting device (2) of the first aspect so as to receive the second DC voltage (V2); and a receiver circuit (31) configured to obtain transmission data by detecting change in the voltage value of the second DC voltage (V2).

The signal receiving device (3) of the second aspect detects change in the voltage value of the second DC voltage (V2) to thereby obtain the transmission data. Therefore, the signal receiving device (3) can offer a decrease in noises caused by reception of the transmission data. Additionally, the signal receiving device (3) of the second aspect need not include oscillators for generating high frequency carriers, and thus circuit configuration thereof can be simplified.

As apparent from the above, the lighting system (4) of the third aspect includes: the signal transmitting device (2) of the first aspect; the signal receiving device (3) of the second aspect; and a lighting device (1) configured to light a light source (5) with the second DC voltage (V2) outputted from the transmitter-side output (21) of the signal transmitting device (2). The lighting device (1) is configured to change a state of the light source (5) according to the transmission data obtained by the receiver circuit (31) of the signal receiving device (3).

The lighting system (4) of the third aspect varies the voltage value of the second DC voltage (V2) to thereby send the transmission data from the signal transmitting device (2) to the signal receiving device (3). Therefore, the lighting system (4) can offer a decrease in noises caused by transmission and reception of the transmission data. Additionally, in the lighting system (4) of the third aspect, the signal transmitting device (2) and the signal receiving device (3) both need not include oscillators for generating high frequency carriers, and thus circuit configuration of the signal transmitting device (2) and the signal receiving device (3) can be simplified.

The lighting system (4) of the fourth aspect would be realized in combination with third aspect. In the lighting system (4) of the fourth aspect, the control circuit (23) is configured to control the voltage conversion circuit (22) to change the voltage value of the second DC voltage (V2) within a range having a predetermined lower limit. The lower limit is equal to or larger than a voltage value necessary for the lighting device (1) to light the light source (5).

The lighting system (4) of the fourth aspect can suppress a fluctuation of an amount of light of the light source (5) within the transmission period.

Generally, voltage conversion causes a loss, and therefore it is preferable to reduce time for voltage conversion.

The lighting system (4) of the fifth aspect would be realized in combination with third or fourth aspect. In the lighting system (4) of the fifth aspect, the control circuit (23) is configured to, in a period different from the transmission period, control the voltage conversion circuit (22) so that the second DC voltage (V2) outputted from the transmitter-side output (21) has a same voltage value as the first DC voltage (V1).

In the lighting system (4) of the fifth aspect, the second DC voltage (V2) has the same voltage value as the first DC voltage (V1) in a time period different from the transmission period (a time period other than the transmission period). Therefore, it is possible to reduce loss which would occur in the signal transmitting device (2) of the first aspect. Note that, the phrase "the second DC voltage (V2) has the same voltage value as the first DC voltage (V1)" means not only that a difference between the voltage value of the second DC voltage (V2) and the voltage value of the first DC voltage (V1) is zero, but also that such a difference between the two voltage values is small to an extent that the difference is substantially considered zero as long as the above loss can be reduced.

The lighting system (4) of the sixth aspect would be realized in combination with any one of third to fifth aspects. In the lighting system (4) of the sixth aspect, the transmission data includes control information (the dimming level) for turning on or off the light source (5). The lighting device (1) is configured to, when the transmission data obtained by the receiver circuit (31) includes the control information for turning on the light source (5) (e.g., the dimming level of more than 0[%]), turn on the light source (5). The lighting device (1) is configured to, when the transmission data obtained by the receiver circuit (31) includes the control information for turning off the light source (5) (e.g., the dimming level of 0[%]), turn off the light source (5).

The lighting system (4) of the sixth aspect can turn on and off the light source (5).

The lighting system (4) of the seventh aspect would be realized in combination with any one of third to sixth aspects. In the lighting system (4) of the seventh aspect, the transmission data includes control information (the dimming level) for adjusting light output of the light source (5). The lighting device (1) is configured to, when the transmission data obtained by the receiver circuit (31) includes the control information for adjusting the light output of the light source (5), adjust the light output of the light source (5) according to the control information for adjusting the light output.

The lighting system (4) of the seventh aspect can adjust an amount of light of the light source (5) (or dim the light source (5)).

The lighting system (4) of the eighth aspect would be realized in combination with any one of third to seventh aspects. In the lighting system (4) of the eighth aspect, the control circuit (23) is configured to define the transmission period as including a plurality of time slots having a constant time width (T0). The control circuit (23) is configured to, in a predetermined time slot, control the voltage conversion circuit (22) so that the voltage value of the second DC voltage (V2) is kept changed within a time width (T1) shorter than the constant time width (T0). The predetermined time slot is a time slot which is one of the time slots and in which the voltage value of the second DC voltage (V2) is changed according to the transmission data.

The lighting system (4) of the eighth aspect can shorten time in which the voltage value of the second DC voltage (V2). Therefore, a change in an amount of light of the light source (5) can be less perceptible to a user.

As apparent from the above, the illuminating fixture (6) of the ninth aspect includes: the signal receiving device (3) of the second aspect; a light source (5); and a lighting device (1) configured to light the light source (5) with the second DC voltage (V2). The lighting device (1) is configured to change a state of the light source (5) according to the data obtained by the receiver circuit (31) of the signal receiving device (3).

The illuminating fixture (6) of the ninth aspect varies the voltage value of the second DC voltage (V2) to thereby send the transmission data from the signal transmitting device (2) to the signal receiving device (3). Therefore, the illuminating fixture (6) can offer a decrease in noises caused by reception of the transmission data. Additionally, in the illuminating fixture (6) of the ninth aspect, the signal receiving device (3) need not include oscillators for generating high frequency carriers, and thus circuit configuration of the signal receiving device (3) can be simplified.

As apparent from the above, the illuminating system (7) of the tenth aspect includes the lighting system (4) of any one of the third to eighth aspects; and the light source (5) to be lit by the lighting device (1).

As apparent from the above, the illuminating system (7) of the eleventh aspect includes: the signal transmitting device (2) of the first aspect; and a plurality of the illuminating fixtures (6) of the ninth aspect. The lighting device (1) and the signal receiving device (3) of each of the illuminating fixtures (6) are electrically connected in parallel with the transmitter-side output (21) of the signal transmitting device (2) through a power supply path (the second power supply path L2) to be supplied with the second DC voltage (V2).

The illuminating system (7) of the eleventh aspect varies the voltage value of the second DC voltage (V2) to thereby send the transmission data from the signal transmitting device (2) to the signal receiving device (3). Therefore, the illuminating system (7) can offer a decrease in noises caused by transmission and reception of the transmission data. Additionally, in the illuminating system (7) of the eleventh aspect, the signal transmitting device (2) and the signal receiving device (3) both need not include oscillators for generating high frequency carriers, and thus circuit configuration of the signal transmitting device (2) and the signal receiving device (3) can be simplified.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

The invention claimed is:

1. A signal transmitting device, comprising:

a transmitter-side input for receiving a first DC voltage;

a transmitter-side output for outputting a second DC voltage;

a voltage conversion circuit configured to convert the first DC voltage into the second DC voltage; and a control circuit configured to control the voltage conversion circuit so that the second DC voltage has a voltage value which changes according to transmission data in a predetermined transmission period, the control circuit being configured to assign binary values of the transmission data to a first voltage value and a second voltage value that is different from the first voltage value, and to control the voltage conversion circuit so that the second DC voltage has the first voltage value or the second voltage value which changes according to one of the binary values of the transmission data to transmit the transmission data.

2. A signal receiving device, comprising:

a receiver-side input to be electrically connected to the transmitter-side output of the signal transmitting device of claim 1 so as to receive the second DC voltage; and a receiver circuit configured to obtain the transmission data by detecting change in the voltage value of the second DC voltage.

3. An illuminating fixture, comprising:

the signal receiving device of claim 2;

a light source; and a lighting device configured to light the light source with the second DC voltage, the lighting device being configured to change a state of the light source according to the transmission data obtained by the receiver circuit of the signal receiving device.

4. A lighting system, comprising:

a signal transmitting device including a transmitter-side input for receiving a first DC voltage, a transmitter-side output for outputting a second DC voltage, a voltage conversion circuit configured to convert the first DC voltage into the second DC voltage, and a control circuit configured to control the voltage conversion circuit so that the second DC voltage has a voltage value which changes according to transmission data in a predetermined transmission period;

a signal receiving device including a receiver-side input electrically connected to the transmitter-side output of the signal transmitting device so as to receive the second DC voltage, and a receiver circuit configured to obtain the transmission data by detecting change in the voltage value of the second DC voltage, and a lighting device configured to light a light source with the second DC voltage outputted from the transmitter-side output of the signal transmitting device, the lighting device being configured to change a state of the light source according to the transmission data obtained by the receiver circuit of the signal receiving device, the control circuit being configured to assign binary values of the transmission data to a first voltage value and a second voltage value that is different from the first voltage value, and to control the voltage conversion circuit so that the second DC voltage has the first voltage value or the second voltage value which changes according to one of the binary values of the transmission data to transmit the transmission data.

5. The lighting system of claim 4, wherein:

the control circuit is configured to control the voltage conversion circuit to change the voltage value of the second DC voltage within a range having a predetermined lower limit; and the lower limit is equal to or larger than a voltage value necessary for the lighting device to light the light source.

6. The lighting system of claim 4, wherein the control circuit is configured to, in a period different from the transmission period, control the voltage conversion circuit so that the second DC voltage outputted from the transmitter-side output has a same voltage value as the first DC voltage.

7. The lighting system of claim 4, wherein:

the transmission data includes control information for turning on or off the light source; and the lighting device is configured to when the transmission data obtained by the receiver circuit includes the control information for turning on the light source, turn on the light source, and when the transmission data obtained by the receiver circuit includes the control information for turning off the light source, turn off the light source.

8. The lighting system of claim 4, wherein the transmission data includes control information for adjusting light output of the light source; and the lighting device is configured to, when the transmission data obtained by the receiver circuit includes the control information for adjusting the light output of the light source, adjust the light output of the light source according to the control information for adjusting the light output.

9. The lighting system of claim 4, wherein the control circuit is configured to:

define the transmission period as including a plurality of time slots having a constant time width; and in a time slot which is one of the time slots and in which the voltage value of the second DC voltage is changed according to the transmission data, control the voltage conversion circuit so that the voltage value of the second DC voltage is kept changed within a time width shorter than the constant time width.

10. An illuminating system, comprising:

the lighting system of claim 4; and the light source to be lit by the lighting device of the lighting system.

11. An illuminating system, comprising:

the signal transmitting device including a transmitter-side input for receiving a first DC voltage, a transmitter-side output for outputting a second DC voltage, a voltage conversion circuit configured to convert the first DC voltage into the second DC voltage, and a control circuit configured to control the voltage conversion circuit so that the second DC voltage has a voltage value which changes according to transmission data in a predetermined transmission period; and a plurality of the illuminating fixtures each including a signal receiving device including a receiver-side input electrically connected to the transmitter-side output of the signal transmitting device so as to receive the second DC voltage, and a receiver circuit configured to obtain the transmission data by detecting change in the voltage value of the second DC voltage, a light source, and a lighting device configured to light the light source with the second DC voltage and configured to change a state of the light source according to the data obtained by the receiver circuit of the signal receiving device, the control circuit being configured to assign binary values of the transmission data to a first voltage value and a second voltage value that is different from the first voltage value, and to control the voltage conversion circuit so that the second DC voltage has the first voltage value or the second voltage value which changes according to one of the binary values of the transmission data to transmit the transmission data, the lighting device and the signal receiving device of each of the illuminating fixtures being electrically connected to the transmitter-side output of the signal transmitting device through a power supply path to be supplied with the second DC voltage.

* * * * *